United States Patent [19]

Tentler

[11] 4,427,092

[45] Jan. 24, 1984

[54] TREE STAND

[76] Inventor: Lynn A. Tentler, Fonddulac, Wis.

[21] Appl. No.: 226,629

[22] Filed: Jan. 21, 1981

[51] Int. Cl.[3] ..... A63B 27/00

[52] U.S. Cl. ..... 182/134; 248/218.4

[58] Field of Search ..... 248/218.4, 219.4; 182/134, 135, 187, 133

[56] References Cited

U.S. PATENT DOCUMENTS

| | | | |
|---|---|---|---|
| 1,542,548 | 6/1925 | Gordon | 182/187 X |
| 1,757,792 | 5/1930 | Cheslock et al. | 248/230 |
| 1,993,320 | 3/1935 | Dozier | 182/187 |
| 2,902,794 | 9/1959 | Ehrgott | 248/188.9 |
| 2,991,842 | 7/1961 | Hardin | 182/187 |
| 3,883,923 | 5/1975 | England | 248/188.9 X |
| 3,955,645 | 5/1976 | Dye | 182/135 |
| 4,022,292 | 5/1977 | Gompel | 182/187 X |
| 4,130,180 | 12/1978 | Ferguson | 182/187 |
| 4,161,233 | 7/1979 | Wirtz | 182/187 |
| 4,244,445 | 1/1981 | Strode | 182/187 X |
| 4,331,216 | 5/1982 | Amacker | 182/135 |

FOREIGN PATENT DOCUMENTS

| | | | |
|---|---|---|---|
| 1049774 | 12/1953 | France | 182/134 |
| 1256889 | 2/1961 | France | 248/188.9 |
| 445664 | 4/1936 | United Kingdom | 248/230 |

*Primary Examiner*—J. Franklin Foss

*Attorney, Agent, or Firm*—Bayard H. Michael

[57] ABSTRACT

The tree stand comprises a platform having a metal support strap encircling the tree with the tree received in a diverging notch in the platform. The sides of the outer portion of the notch are convex and the sides of the inner portion of the notch are concave to permit a wide range of tree diameters to be engaged by the notch. All tree sizes in the range are contacted at widely spaced points and smaller trees are gripped by the notch. The notch is lined with a ribbed rubber facing and the strap is rubber covered where it contacts the tree.

2 Claims, 4 Drawing Figures

TREE STAND

FIELD OF THE INVENTION

This invention relates to tree stand comprising a platform to be temporarily mounted on a tree or post, the platform having a notch partly embracing the tree. The sides of the notch are rubber lined and concave and convex to contact the tree trunk at widely spaced points. The metal strap embracing the tree is rubber covered.

BACKGROUND OF THE INVENTION

Tree stands are used by hunters, photographers and naturalists to obtain a high viewing position. Typically, the tree stand includes a platform supported on the tree by a strap arrangement of some sort. The support strap is designed to encircle the tree and permit the platform and strap to be raised on the tree and then grip the tree when the platform is loaded. The platform has toe straps in which the user's feet are inserted. The user then either grips (bear hug) the tree and flexes his knees to raise the platform or the user uses some sort of climbing aid to pull himself and the tree stand up the tree. In either event, when the user loads the platform the support strat engages the tree and the platform rests against the tree. Tree stands presently available generally have a V-shaped or curved notch which receives the tree trunk. The edge of the notch facing the tree can be provided with teeth or serrations to dig into the bark to reduce slippage of the platform on the tree. The platform is tippy on certain sized trees and if care is not exercised, the platform can slide down the tree trunk rapidly with considerable danger to the user. The platforms on the market damage the tree by puncturing the bark which permits certain beetles to get under the bark and kill the tree. As a result, many forest managers ban the use of tree stands or other devices which can puncture the bark.

SUMMARY OF THE INVENTION

The object of this invention is to provide a tree platform which is stable in use. This is accomplished by providing an outwardly diverging rubber lined notch having a generally concave root portion and a generally convex outer portion to grip a wide range of tree sizes. The notch will grip the tree at spaced points in the neighborhood of 90° apart so long as the tree falls within the design range of trunk sizes, 6"–24Δ, for example. The rubber lining is ribbed and does not harm the tree while being considerably more effective than metal teeth or the like. The concave/convex notch permits the points of contact with the tree to remain close enough to support axis of the platform to preclude the user placing his weight so close to the tree as to tip the platform and cause release (resulting in a fast ride to the ground).

The metal strap which embraces the tree is rubber covered where it contacts the tree. This holds better than the prior art teeth, does not damage the tree, and is quieter. The rubber is shaped to compliment the angle of the strap to the tree to increase the bearing area.

DETAILED DESCRIPTION OF THE DRAWINGS

Figure 2:
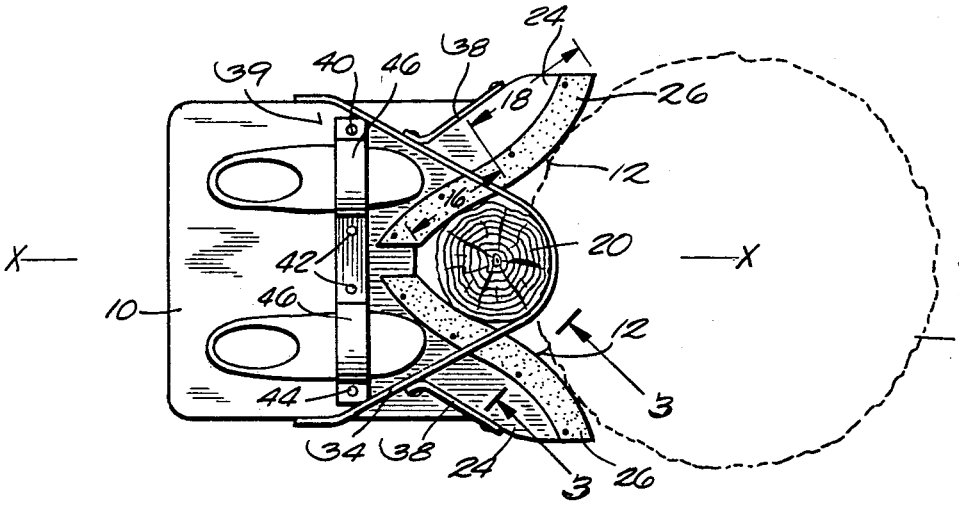
FIG. 2 is a horizontal section illustrating how the notch adapts to trees of various diameters.

The platform 10 is made of ¾" exterior or marine grade plywood and has a generally rectangular shaped with a notch 12 in one end. The shape of each side of the notch is concave in the root portion 16 and convex in the outer portion 18 to enable the notch to engage a small diameter tree 20 (illustrated in solid lines) or a large diameter tree 22 (dotted lines in FIG. 2) at widely spaced points without being so widely spaced as to wedge the platform onto the tree making disengagement difficult or impossible from a practical standpoint. It will be noted the tips 24 of the notch extend beyond the sides of the platform. This allows the platform to be used on larger trees than would otherwise be the case without unduly increasing the size or weight of the platform. The notch 12 is lined with a rubber (elastomer) facing 26 having parallel ribs 28 to engage the tree or post. The facing 26 is molded or extruded and has sides 30 which fit over the edge of the plywood and are secured to the plywood by large head (shingle) nails 32.

The platform must be provided with a support strap. The metal strap 34 is secured to the sides of the platform by means of the pins 36 (or a bracket not illustrated) to permit pivoting to a storage (transport) position. A strut 38 on each side holds the strap at the desired angle to the platform. The portion of the strap contacting the tree passes through and is enclosed by an extruded rubber cover 35. The lower edge of the rubber facing the tree is thicker than the upper edge so as to be substantial parallel to the tree to increase the bearing area. The rubber surface facing the tree is ribbed. This arrangement is quiet and obtains an excellent grip on the tree. Obviously, the strap length must be adjustable to embrace trees of various diameters. It is adjusted so the platform will be horizontal when weighted and the strap is tight against the tree. The adjusting means are not shown.

Figure 1:
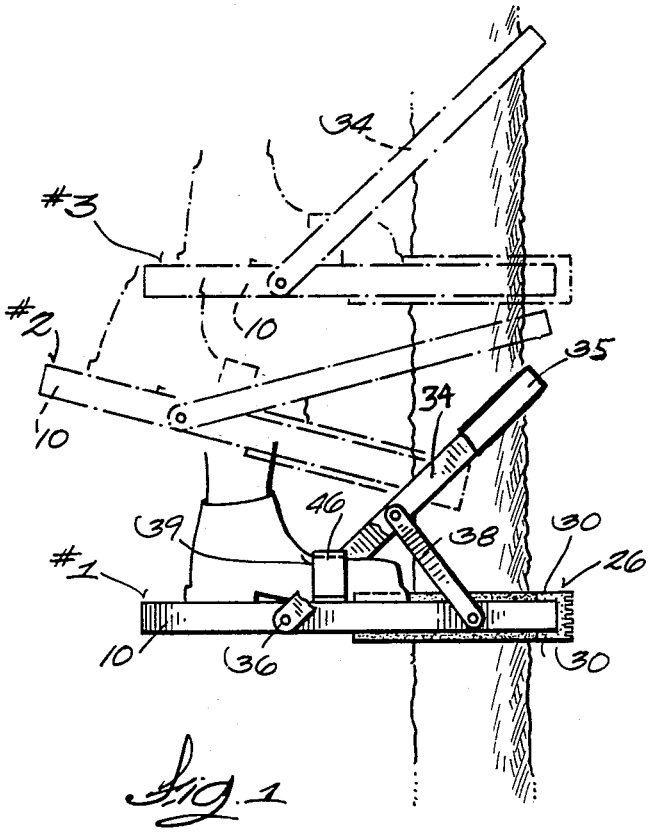
FIG. 1 is a side elevation of the platform in use and illustrates the manner in which it can be used to climb a tree.
Figure 3:
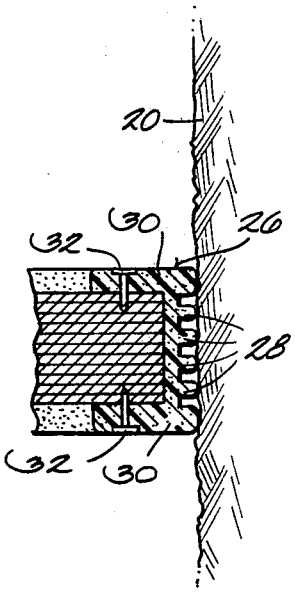
FIG. 3 is a cross-section on line 3—3 in FIG. 2 to show the details of the rubber lining of the notch.
Figure 4:
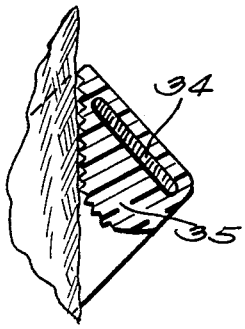
FIG. 4 is a cross-section on line 4—4 in FIG. 2 to show the rubber enclosing the strap.

The platform is provided with a toe strap 40 secured to the platform at 40, 42, 44 to make two loops 46 receiving the toe portion of the user's boots. In use this permits the user to support himself on the tree (by means of a bear hug or by hanging on a climbing aid) and then flex his knees to tilt the platform as illustrated in #2 in FIG. 1. This disengages the platform from the tree and the user then raises the platform and strap up the tree. The platform is then re-engaged with the tree (#3 in FIG. 1). The platform is lowered to position #1 (FIG. 1) by reverse action. It sounds harder than it is.

The rubber lined concave/convex notch is a great improvement over the prior art. When engaging a small diameter tree in the root portion of the notch the concave shape permits the points of engagement on the tree to be generally about 90° apart to be as far off the longitudinal axis x—x of the platform as practical while having the weight on the platform drive the platform with a partially wedging action to grip the tree firmly. With the contact points spread and the notch partly wedging into the smaller tree, good stability is obtained as opposed to the prior art which is quite unstable on smaller trees. If the points of contact are too far apart, the notch would wedge on the tree so the user would find it practically impossible to disengage the platform. As the size of the tree increases the point of engagement with the notch moves further out of the notch and with a large tree is well out onto the convex curvature as illustrated in FIG. 2. Here the points of engagement with the tree are still generally about 90° and achieve great stability about axis x—x without appreciable wedging. The grip on the tree is greatly enhanced by the rubber lining 26. The prior art V-shaped notches are generally shallow notches so the platform will fit larger trees. When used on small trees the points of engagement with the platform are two close to the x—x axis, the notch does not grip or wedge on the tree and the platform is tippy. If the notch is sharp (deep) the useable range of tree sizes decreases and it is possible to stand too close to a line through the points of contact so there is not enough leverage forcing the platform into the tree and the platform can slip or tilt with disastrous results. The prior art curved (concave) notches are possibly worse than the shallow V.

This platform is exceptionally stable and can even withstand the user bouncing up and down on his toes (the weight should never leave the platform completely) when his feet are closer to the tree than to the outer edge. Prior art tree stands "lose their grip" under such circumstances and the user will predictably find the platform sliding down the tree rapidly. Most users prefer to not have such thrills. The platform is quite stable about the x—x axis, even on small trees. The prior art requires the user to have great faith as the platform wobbles about the x—x axis and sometimes such faith is misplaced since the platform can lose its grip.

This tree stand does not harm the tree and can be used in areas where other tree stands are prohibited because they puncture the bark. It is an ideal stand for persons concerned with the environment. The provision of rubber (elastomer) facing on the tree engaging surfaces of the platform and the metal strap is very effective in preventing the tree stand from sliding down the tree even without the concave/convex notch in the platform. The grip on the tree is superior and the tree stand does not damage the tree.

While the notch shape has been referred to as concave/convex it will be appreciated that a series of straight lines can achieve the same effect and are within the scope of this invention. While not as desirable, the concave/convex notch could be carried by the strap and the platform could then have a V-notch or an arcuate notch. There is no advantage in such an arrangement and there is the disadvantage of more bulk on the strap.

I claim:

1. A tree stand comprising, a platform having a notch therein adapted to bear against a tree trunk of 6" diameter or more at points well spaced from an extension of the centerline of the platform and notch, a metal support strap which is flexible along its length to enable it to embrace the tree trunk and which is adjustably connected to the platform so the platform is generally horizontal in use, said notch engaging one side of a tree and the strap engaging the other side of the tree at a vertically elevated location so weight on the platform tends to drive the platform against the tree trunk and tilting the outer or front portion of the platform upwardly acts to disengage the tree stand from the tree the notch has sides which diverge from the root of the notch, the sides of the root portion of the notch being concave and leading to outer convex portions, the concave and convex curves being selected so a small diameter tree engages the sides close to the root of the notch and progressively larger trees contact the sides progressively further from the root, an elastomer facing on the tree engaging surface of the notch, an elastomer facing on the tree engaging surface of the strap, said elastomer facings acting to grip the tree to mount the platform on the tree without sliding and without damage to the tree.

2. A tree stand according to claim 1 in which trees 6" in diameter and greater are engaged by the notch at points about 90° apart relative to the center of the tree to retain the platform on the tree without slipping and without damage to the tree.

* * * * *